United States Patent [19]

Kuo

[11] 4,214,954

[45] Jul. 29, 1980

[54] PLATED METALLIC CATHODE WITH POROUS COPPER SUBPLATING

[75] Inventor: Han C. Kuo, Cleveland, Tenn.

[73] Assignee: Olin Corporation, New Haven, Conn.

[21] Appl. No.: 965,814

[22] Filed: Dec. 4, 1978

Related U.S. Application Data

[60] Division of Ser. No. 901,897, May 1, 1978, Pat. No. 4,152,240, which is a continuation-in-part of Ser. No. 892,554, Apr. 3, 1978, Pat. No. 4,162,204.

[51] Int. Cl.[2] ..... C25D 3/56; C25D 3/38

[52] U.S. Cl. ..... 204/32 R; 204/40; 204/43 T

[58] Field of Search ..... 204/43 R, 43 T, 290 R, 204/32 R, 40

[56] References Cited

U.S. PATENT DOCUMENTS

| | | | |
|---|---|---|---|
| 3,291,744 | 12/1966 | Hall | 204/256 |
| 3,926,844 | 12/1975 | Benczur-Urmossy | 252/432 |
| 3,947,331 | 3/1976 | Kinh et al. | 204/37 R |
| 4,033,837 | 7/1977 | Kuo et al. | 204/98 |
| 4,088,547 | 5/1978 | Albertson | 204/32 R |
| 4,098,671 | 7/1978 | Westerlund | 204/284 |
| 4,105,531 | 8/1978 | Kuo et al. | 204/290 R |
| 4,116,804 | 9/1978 | Needes | 204/290 R |

OTHER PUBLICATIONS

Malachowski, Zesz. Nauk. Politech. Slask. Chem., No. 65, pp. 235–236, (1973).

Higashi et al., Kinzoku Hyomen Gisyutsu, vol. 27, No. 11, 590–595, (1976).

Imanaga, Kinzoku Hyomen Gijutso, vol. 19, No. 2, 73–78, (1968).

Stasov et al., Elektrokhimiya, vol. 8, No. 9, pp. 1331–1333, 8/71.

*Primary Examiner*—F. C. Edmundson

*Attorney, Agent, or Firm*—Bruce E. Burdick; Thomas P. O'Day

[57] ABSTRACT

A low overvoltage cathode is disclosed which has a metal substrate plated with a porous coating of dendritic copper which is in turn plated with a low overvoltage metal alloy. The substrate is preferably copper and the low overvoltage alloy is preferably a Ni-Mo alloy.

4 Claims, 2 Drawing Figures

PLATED METALLIC CATHODE WITH POROUS COPPER SUBPLATING

Figure 1:
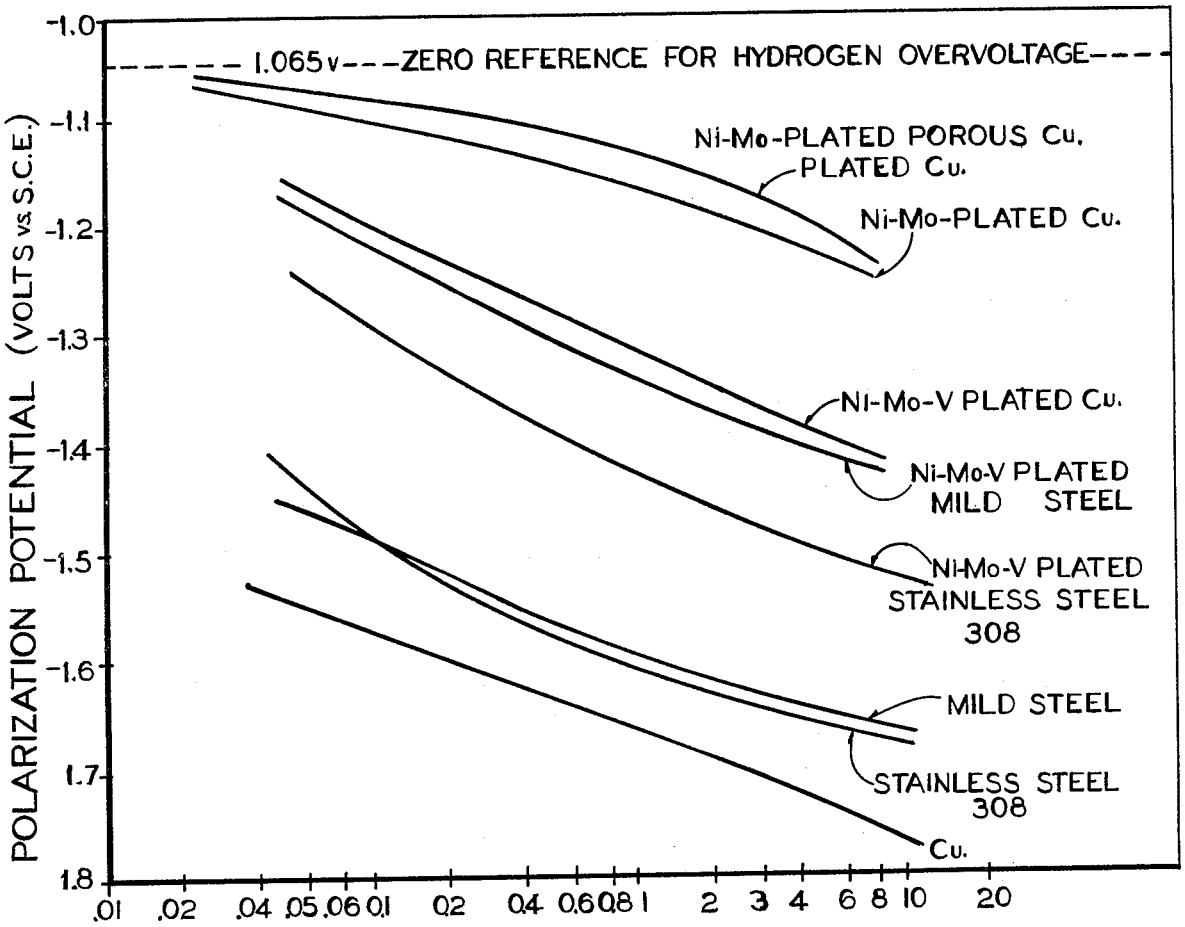

This is a division, of application Ser. No. 901,897, filed May 1, 1978 now U.S. Pat. No. 4,152,240 which is a continuation-in-part of parent application Ser. No. 892,554 filed Apr. 3, 1978 now U.S. Pat. No. 4,162,204.

This invention relates to electrochemical cells and specifically to low overvoltage coatings for electrodes, especially cathodes, for use in such cells.

One of the largest costs in the operation of electrolytic cells is that of electrical energy. Consequently, efforts have been made to reduce the working voltage of the cell. One of the components contributing to the working voltage is the overvoltage at the cathode. In the case of a cell used for the electrolysis of alakli metal chloride solutions, for example, this component is referred to as hydrogen overvoltage.

Previously, cathodes have been constructed of various metals such as low-carbon steel, titanium, nickel, chromium, copper, iron, tantalum, and the like, and alloys thereof, especially stainless steel and other chromium steels, nickel steels, and the like. For a given structural configuration, current density, temperature, and electrolyte, each of these metals when used as a cathode will possess a given overvoltage.

In an article published in *Zeszyty Naukowe Politechniki Slaskiej*, Chemia No. 65, pp. 235 and 236, 1975 (Poland), by Andrzej Malachowski, there is disclosed an electrode having a reduced hydrogen overvoltage. The electrode disclosed in the article comprised a steel substrate plated with a nickel, molybdenum, vanadium alloy. Although a Ni-Mo-V plated steel electrode does have a reduced overvoltage, it has been found to be prone to corrosion, even to the extent that the plating will peel off after a few weeks when the potential is removed.

Similarly, in U.S. Pat. No. 3,291,744, issued to J. R. Hall et al on December 13, 1966, there are disclosed electrodes having reduced overvoltage. The electrodes disclosed in the Hall et al patent comprise a steel or titanium substate plated with various alloys selected from the group consisting of tungsten-iron, molybdenum-cobalt, molybdenum-nickel (Ni-Mo), molybdenum-iron, molybdenum-iron-cobalt, molybdenum-nickel-iron and molybdenum-nickel-cobalt. However, these electrodes have also been found to be subject to corrosion, even to the extent that the plating will peel off after a few weeks of use in a caustic environment such as when used as the cathode of an electrolytic chlor-alkali cell.

There is further shown in U.S. Pat. No. 4,033,837, issued July 5, 1977 to H. C. Kuo et al, and in application Ser. No. 812,210, filed July 1, 1977 by H. C. Kuo et al a nickel-molybdenum-vanadium (Ni-Mo-V) alloy plated copper electrode having reduced hydrogen overvoltage. The Kuo et al patent teaches that Ni-Mo-V platings are preferred for producing low overvoltage cathodes. The Kuo et al application teaches that with a pH of 9–11 and a lower vanadium concentration in the plating bath than that suggested by the Kuo et al patent a lower overvoltage is produced but, if the vanadium is decreased below 0.4 g/l, the cathode overvoltage increases.

There is further known from U.S. Pat. No. 3,947,331, issued to V. Q. Kinh et al on March 30, 1976, a 30–40 μm non-fissured Ni-Mo plating over a 10–40 μm fissured Ni-Mo which is in turn plated over a 5–30 micron (μm) non-fissured sublayer of plated nickel on a cleaned copper substrate for corrosion resistance. A lower limit of 5 A/dm$^2$ is specified for plating current density. The outer non-fissured coating is of 30–40 μm and has 15–50 percent by weight molybdenum. The coating is then heat treated at 700°–1200° C. for 2–24 hours. Overvoltage is not considered.

There is further known in U.S. Pat. No. 3,926,844, issued Dec. 16, 1975 to Gabor BenczurUrmossy, a Ni-B, Co-B or Fe-B low overvoltage coating on a wide variety of supporting structures, especially a Raney nickel surface. Complexing agents such as ammonia, ethylenediamine, alkali metal tartrates, alkali metal citrates, etc. are used to complex the metallic ions in the plating bath.

It is an object of the present invention to provide a durable electrode which has both lower hydrogen overvoltage than the prior art mild steel electrodes and good corrosion resistant properties.

The above objects may be accomplished, according to the preferred form of the invention, through the provision of a low overvoltage cathode produced by a process which comprises:

(a) cleaning a conductive metal substrate;

(b) plating said cleaned metal substrate with a porous coating of from about 50 to about 200 microns thickness of dendritic copper; and (c) plating said porous coated copper substrate with a coating of a low overvoltage metal alloy.

Figure 2:
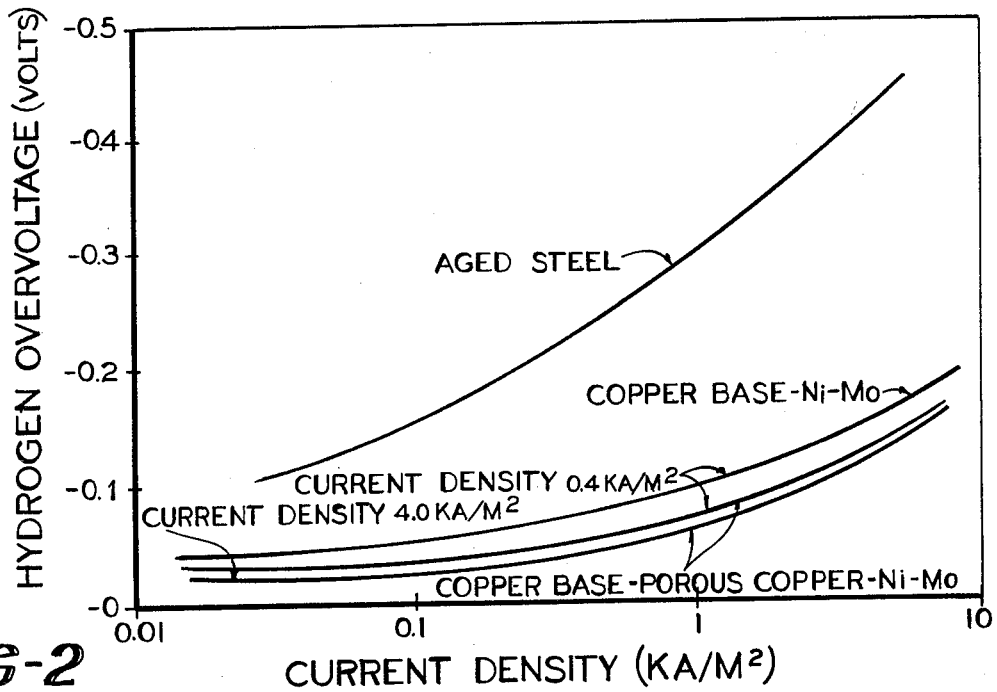

A better understanding of this invention may be had by reference to the following detailed description and to the accompanying drawing in which:

FIG. 1 is a graph plotting the polarization potential against current density for various plated and unplated cathodes including the Ni-Mo over porous copper coated cathode of the invention; and FIG. 2 is a graph plotting hydrogen overvoltage of two Ni-Mo coated porous copper cathodes and one Ni-Mo coated clean copper cathode rod.

More specifically, it is contemplated that the electrode structure may be a cathode of any shape suitable for the intended purpose. For example, the cathode of the present invention may comprise a plate, a rod, a foraminous structure, or mesh of any shape well known in the art.

The preferred cathode is a conductive metal (e.g., copper) mesh substrate plated with an intermediate coating of porous dendritic metal (e.g., copper) and an outer coating of a low overvoltage metal alloy (e.g., nickel-molybdenum with at least 50 weight percent molybdenum). The preferred porous dendritic copper and nickel-molybdenum coatings can be applied by a copper plating bath and a nickel plating bath, respectively.

Prior to immersing the copper substrate in the porous copper plating bath or the Ni-Mo plating bath, the surface of the substrate should be cleaned. This can be accomplished by conventional techniques well known in the art for cleaning preparatory to nickel plating. For example, the copper substrate may be etched in a solution containing 10 to 40 percent volume parts sulfuric acid having a concentration of 97 percent $H_2SO_4$ by weight, and 5 to 20 volume parts nitric acid having a concentration of 71 percent $HNO_3$ by weight and 40 to 85 volume parts water for about 5 to 15 minutes at room temperature. Alternatively, it may be cathodically cleaned in a caustic solution of 10 to 20 weight parts sodium hydroxide and 80 to 90 weight parts water at room temperature at 20 to 80 ma/cm$^2$ for about 5 to 10 minutes.

As another and most preferred alternative, the copper substrate may be cleaned by first soaking the substrate in an alkaline cleaner, such as for example, an aqueous solution of about 10 to 20 weight percent NaOH, and then rinsing the substrate with deionized water; second, anodically cleaning the substrate in an aqueous solution of about 60–90 grams of Oxyprep 293 (Oxymetal Industries Corp.) per liter of solution at an anodic current of 2–8 a/dm$^2$ for 2–10 minutes and rinsing with deionized water; and thirdly dipping the substrate in an aqueous solution of about 10–15 weight percent hydrochloric acid for from about 10–30 seconds and then rinsing the substrate with deionized water.

After either of the above operations, the copper substrate is preferably rinsed with deionized water. Prior to immersing the copper substrate into the plating bath, it may be immersed in a solution of about 10 volume parts sulfuric acid having a concentration of 97 percent $H_2SO_4$ by weight, about 10 to 15 volume parts hydrochloric acid having a concentration of 37 percent HCl by weight, and about 80 volume parts water, room temperature, for 10 to 30 seconds and then rinsed with deionized water.

The copper cathode may also be cleaned by a 30 percent nitric acid solution and rinsed with deionized water. Other cleansing procedures may also be used, the cleansing merely serving to remove any film on the copper substrate so as to provide more adherent coatings.

After being cleaned by one of the above cleaning procedures, the clean copper substrate is then plated with a 50–200 micron porous layer of dendritic copper. A preferred bath which produces such a coating is an aqueous bath having from about 30 to about 200 grams per liter (g/l) of cupric sulfate and from about 50 to about 100 g/l of sulfuric acid at from ambient temperature up to about 60° C. A current density of 0.01 to 2.0 kiloamperes per square meter (KA/m$^2$) applied for from about 60 minutes to about 90 minutes is sufficient to produce the 50–200 micron dendritic layer. Particularly preferred is such a bath having 150 g/l cupric sulfate and 50 g/l (26 ml/l) at ambient temperature and a plating current density of 0.4 KA/m$^2$, applied for from about 60 minutes. The dendritic copper layer thus produced has been observed to comprise dendrites of about 2 to 10 microns in diameter.

This dendritic layer is porous because it comprises a multiplicity of dendrites, i.e. tree-like or arborescent crystals, stacked randomly atop each other. For those unfamiliar with metallurgical structures, dendrites can be visualized as being similar to rigid snowflakes in structure. If such dendrites are stacked on top of each other, they form a layer somewhat like a blanket of snow. In the case of copper dendrites, however, the layer is adherent and can be visualized as glue-covered snowflakes. The surface area of the cathode is thus greatly increased and appears much as if a multitude of microscopic metal trees were projecting from the substrate. When a given amount of current is passed across such a surface, the local current density at any given point is believed to be reduced even though the overall cathode current density is still the same.

While copper dendrites are known to produce desirable results, as seen in the Example, other porous dendritic conductive layers could be utilized after routine experimentation to determine if the adhesion, corrosion resistance, conductivity and overvoltage when coated with a low overvoltage alloy are found comparable to a porous dendritic copper layer.

Any one of the low overvoltage metal alloys listed in Table I below could be utilized in place of the preferred Ni-Mo coating if routine experimentation proved that coating to give results comparable to the Ni-Mo alloy coating when used on the particular porous sublayer chosen.

TABLE 1

| | COATING | REFERENCE |
|---|---|---|
| 1. | Ni-Mo-V | U.S. Pat. No. 4,033,837 |
| 2. | W-Fe | U.S. Pat. No. 3,291,714 |
| 3. | Mo-Co | U.S. Pat. No. 3,291,714 |
| 4. | Fe-Mo | U.S. Pat. No. 3,291,714 |
| 5. | Fe-Mo-Ni | U.S. Pat. No. 3,291,714 |
| 6. | Fe-Co-Ni | U.S. Pat. No. 3,291,714 |
| 7. | Ni-Co-Mo | U.S. Pat. No. 3,291,714 |
| 8. | Fe-B | U.S. Pat. No. 3,926,844 |
| 9. | Ni-B | U.S. Pat. No. 3,926,844 |
| 10. | Co-B | U.S. Pat. No. 3,926,844 |
| 11. | TiNa-Ni | West German Patent No. 2,630,398 |

After porous copper coating is applied, the porous copper plated copper cathode structure may be immersed in a Ni-Mo plating bath.

The nickel-molybdenum plating is preferably electrodeposited on the copper substrate using a nickel bath with the addition of amounts of molybdenum in a form that will provide a source of ions to be deposited by discharge in an aqueous solution. The bath may be an aqueous solution of nickel salts (nickel sulfate and nickel chloride) in the amount of 20 to 150 g/l (grams per liter), sodium molybdate in the amount of 1 to 40 g/l, and complexing agents in the amount of 20 to 100 g/l.

Suitable complexing agents are alkali metal citrates, tartrates and pyrophosphates. Particularly preferred are sodium citrate and sodium pyrophosphate. The complexing agent is preferably added in a molar concentration approximately equal to the molar concentration of nickel salts plus molybdenum salts.

About 5–15 grams ferrous salts per liter of plating solution may be added to the plating bath and hence to the coating to produce a ternary Ni-Fe-Mo coating on the copper substrate, giving the plated cathode an overvoltage approximately the same as has the Ni-Mo coated copper cathode, namely 200 to 250 millivolts less than that of a steel cathode. The bath can have a pH of 9 to 11 and be at a temperature of 20° to 45° C. The plating current density can be 0.4 to 50 A/dm$^2$ and is preferably 3.0–5.0 A/dm$^2$. The plating operation can continue for 15 to 90 minutes until a layer of alloy material has been deposited having a thickness of 1–5 $\mu$m and preferably of 2–4 $\mu$m.

The resulting product is a cathode having a copper substrate with a porous dendritic copper layer and a plating of nickel and at least 50 percent by weight molybdenum thereon.

Other cleaned conductive metal substrates, such as for example, steel, titanium or nickel could be substituted for the preferred copper substrate.

The cathodes of the present invention unexpectedly and surprisingly exhibited lower hydrogen overvoltages at all observed current densities as compared with bare copper, bare mild steel, bare stainless steel 308, Ni-Mo-V plated steel, and Ni-Mo-V plated copper and Ni-Mo plated copper. In addition, the plated copper cathode of the present invention shows improved corrosion resistant properties as compared to a mild steel plated with the same alloy.

The cathode of this invention is particularly useful in chlor-alkali electrolytic cells. However, it is contemplated that it may also be used in the electrolysis of water.

While a copper cathode and Ni-Mo coating are shown in the examples below, a nickel, steel or titanium substrate in the form of perforated plate or louvered mesh could be used and the low overvoltage coating could be replaced by any conventional low overvoltage coating which through routine experimentation is found adherent to a porous dendritic copper coated copper substrate and of sufficient corrosion resistance in the catholyte for which its use is intended.

The porous dendritic copper coating is believed to cause a reduction in electrode overvoltage by giving an increased surface area to the cathode and thus allowing increased surface area for the low overvoltage coating to thereby reduce the actual surface current density on the cathode surface. Overvoltage has been found to be lower for lower current densities.

The following example is presented to better define the invention without any intention of being limited thereby. All parts and percentages are by volume at room temperature unless otherwise indicated. A Luggin capillary tube with a saturated calomel reference electrode is used to monitor overvoltage. A salt bridge of 25 percent brine is inserted between the Luggin capillary and the reference electrode. IR drop during the polarization is automatically compensated for by a potentiostat.

EXAMPLE 1

Three copper rods of diameter of ¼ inch were cleaned by the following procedure. The copper substrate was soaked in a solution containing 15 percent by weight sodium hydroxide for 20–30 minutes and then rinsed with deionized water. The substrate is then anodically cleaned in an aqueous solution of 75 grams of Oxyprep 293 (Oxymetal Industries Corp.) per liter at an anodic current of 7.5 a/dm$^2$ for two minutes and then rinsed with deionized water. The substrate was then dipped for 10–30 seconds in a 10–15 percent HCl by weight aqueous solution and then again rinsed in deionized water.

The first rod was plated at 0.4 KA/m$^2$ for 1 hour in Ni-Mo alloy plating bath of the following composition:

| | |
|---|---|
| Nickel Chloride | 0.1 m |
| Nickel Sulfate | 0.1 m |
| Sodium Molybdate | 0.04 m |
| Sodium Citrate | 0.2 m |
| pH = 9.5 ($NaCO_3$) | |

The second rod was first plated with a layer of porous dendritic copper in a bath of the following composition:

| | |
|---|---|
| Cupric Sulfate | 150 g/l |
| $H_2SO_4$ | 26 ml/l (about 50 g/l) |

at 0.4 KA/m$^2$ for 1½ hours. The final layer was plated with the Ni-Mo alloy at 0.4 KA/m$^2$ for 1 hour in a bath as was the first rod.

The third rod was also first plated with a layer of porous dendritic copper under the same conditions as the second rod, then plated with the final Ni-Mo alloy in the same bath as for the first rod at 4.0 KA/m$^2$ for 1 hour.

The attached FIG. 1 shows the hydrogen overvoltage of the three plated rods in 200 g/l NaOH at 80° C.

The hydrogen overvoltage of the Ni-Mo plated rod was further reduced about 30 or 40 mv with the porous copper undercoat.

What is claimed is:

1. An improved method of making a hydrogen evolution, low overvoltage cathode for use in an electrolysis cell, which comprises the steps of:
   (a) cleaning a conductive metal substrate;
   (b) depositing upon said cleaned metal substrate a porous subcoating of from about 50 to about 200 microns thickness of dendritic copper so as to increase the surface area of said cathode; and
   (c) depositing upon said porous copper subcoated substrate a coating of a low overvoltage metal alloy.

2. The cathode of claim 1 wherein said metal substrate is copper.

3. The method of claims 1 or 2 wherein said porous coating is applied by placing said cleaned conductive metal substrate as the cathode in a plating cell containing an aqueous plating bath having 30 to 200 grams of cupric sulfate and 50 to 100 grams of sulfuric acid per liter of solution and applying a current at a current density of 0.01 to 2 KA/m$^2$ across said cathode and bath.

4. The method of claim 3 wherein said current is applied across said cathode and bath for from about one hour to about one and one-half hour.

* * * * *